United States Patent [19]

Kennedy et al.

[11] 4,023,378

[45] May 17, 1977

[54] REFRIGERATION SYSTEM INCORPORATING A SINGLE AIR CIRCULATION MEANS FOR A COMBINATION REFRIGERATED DISPLAY CASE AND WALK-IN COOLER

[75] Inventors: Thomas E. Kennedy; Earl E. Butts; Melvin W. Steelman, all of Niles, Mich.

[73] Assignee: Tyler Refrigeration Corporation, Niles, Mich.

[22] Filed: Aug. 1, 1975

[21] Appl. No.: 601,576

[52] U.S. Cl. ..... 62/256; 62/428; 98/36

[51] Int. Cl.[2] ..... A47F 3/04

[58] Field of Search ..... 62/246, 255, 256, 428, 62/414; 98/36; 165/126

[56] References Cited

UNITED STATES PATENTS

| | | | |
|---|---|---|---|
| 2,923,137 | 2/1960 | Swanson | 62/256 |
| 2,961,845 | 11/1960 | Kennedy | 62/256 |
| 2,984,085 | 5/1961 | Rainwater | 62/256 |
| 3,044,274 | 7/1962 | Mathis et al. | 62/256 |
| 3,238,999 | 3/1966 | Mallinger | 165/126 X |
| 3,501,925 | 3/1970 | Brennan et al. | 62/256 |
| 3,664,253 | 5/1972 | Asker et al. | 98/36 |
| 3,698,205 | 10/1972 | Perez | 62/256 |

*Primary Examiner*—William E. Wayner
*Assistant Examiner*—William E. Tapoleai, Jr.
*Attorney, Agent, or Firm*—LeBlanc & Shur

[57] ABSTRACT

A combined refrigerated display case and walk-in cooler wherein an improved refrigeration system combines a single air circulation means and two distinct refrigeration units, a first refrigeration unit dispersing refrigerated air for a plurality of air curtains travelling across an access opening provided at the front of the display case portion of the combination, a second refrigeration unit dispersing refrigerated air rearwardly to the walk-in cooler portion of the combination. The front access opening provides unimpeded access to the refrigerated space of the display case. Support means are provided between the walk-in cooler portion and display case portion extending between a lower surface of the refrigeration system and the floor for carrying shelves associated with the refrigerated display case portion of the combination. Goods may be removed from the shelves by purchasers through the display case access opening and goods may be deposited thereon by suppliers through a rear access opening between the display case portion and the refrigerated walk-in cooler portion of the combination. A barrier such as a curtain or other protective means is also provided between the refrigerated display case portion and the walk-in cooler portion of the combination to environmentally separate the two sections or portions during normal usage. The refrigerated air forming the curtains in front of the refrigerated display space is recirculated into the walk-in cooler space after passing under the refrigerated display space.

10 Claims, 1 Drawing Figure

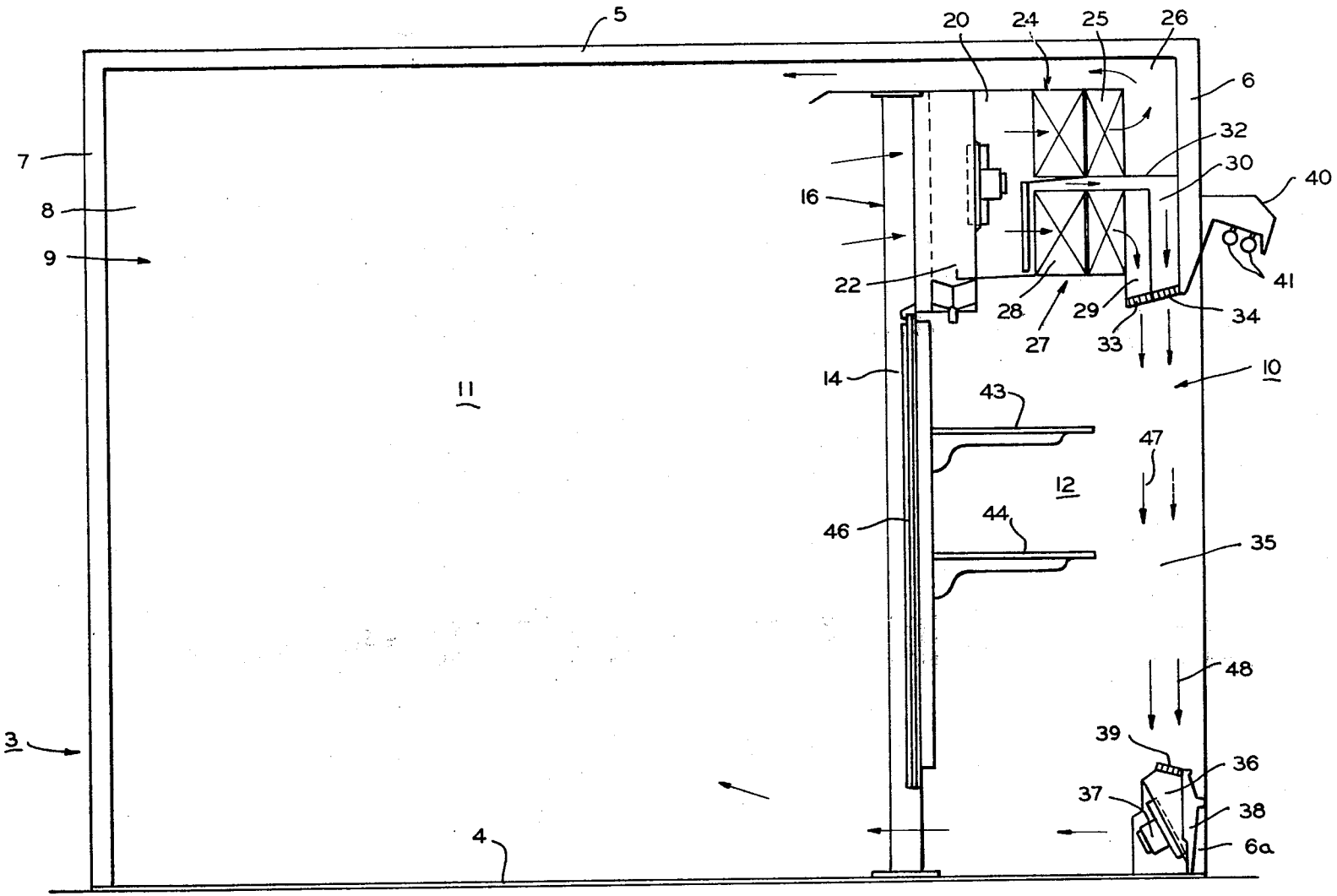
40
41
6
32
30
34
10
35
48
36
38
6a
26
25
24
20
47
33
29
27
28
12
43
44
39
37
22
14
46
16
5
11
4
7
8
9
3

REFRIGERATION SYSTEM INCORPORATING A SINGLE AIR CIRCULATION MEANS FOR A COMBINATION REFRIGERATED DISPLAY CASE AND WALK-IN COOLER

BACKGROUND AND SUMMARY OF THE INVENTION

This invention relates to combined refrigerated display cases and cold rooms or walk-in coolers of the type having an opening in front for unimpeded access to the refreigerated space and an opening between the display case and the cold room for access therebetween. The present invention provides a compact system which uses a single air circulation means or fan system with two separate refreigeration units associated with the system.

One of these units provides a current of refrigerated air which is directed across an access opening at the front of the display space of the refrigerated display case in multiple layers or curtains. The access opening permits unimpeded access to the display space for merchandising in an environment such as a supermarket or other retail establishment. The purpose of the air curtains is to prevent the ambient air from the supermarket or merchandising environment from entering the refrigerated display case and for preventing the refrigerated air from the display case from exhausting into the room or other marketing environment.

A second refrigeration unit provided adjacent the first refrigerated unit circulates air to the walk-in cooler portion of the combination. The cold room or walk-in cooler is of the type which may be used for food preparation or storage, which room may be maintained at the same or different temperature than the display case. The fan system draws the recirculated air back into the respective refrigeration units for recooling and recirculation.

Additionally, columns provided in the combination and extending from the floor to a lower surface of the system support shelves associated with the display case portion of the combination. Means are provided on the supporting columns for closing the rear access opening of the display case during normal use periods.

It is an object of the present invention to provide a compact refrigeration system comprising a single fan system and a plurality of refrigeration units for a refrigerated display case and walk-in cooler combination.

It is another object of the present invention to provide a combination walk-in cooler and refrigerated display case with an improved refrigeration system including separate refrigeration units for each portion of the combination, a first refrigeration unit providing a plurality of air curtains across the front access opening of the refrigerated display case portion of the combination, a second refrigeration unit providing refrigerated air to the walk-in cooler portion of the combination, the refrigeration units combined with a single fan system for circulation of refrigerated air through both units.

It is a further object of the present invention to provide means for supporting the refrigeration system of the walk-in cooler and display case combination including supporting means for shelving associated with the display case portion of the combination, the supporting means being provided between the display case and the walk-in cooler portions of the combination and permitting access therebetween.

Other objects of the present invention will become apparent upon inspection of the drawings and specification and will be pointed out in the claims.

BRIEF DESCRIPTION OF THE DRAWINGS

The drawing is an end elevational view, partially in section, of the refrigerated display case and walk-in cooler combination of the present invention.

DETAILED DESCRIPTION OF THE PREFERRED EMBODIMENT

A walk-in cooler and display case combination 3 includes a floor 4, a top wall 5, a front wall portion 6 extending downwardly from the top wall 5, a rear wall 7 and side walls 8. The walk-in cooler and display case combination 3 comprises a walk-in cooler portion 9 and a display case portion 10 having respective walk-in cooler space 11 and refrigerated display space 12. Between the walk-in cooler space 11 and the display space 12 is provided a plurality of uprights 14 appropriately spaced along the length of the combination 3, each of the uprights 14 extending between the floor 4 and a lower surface of a refrigeration system 16 for the combination 3. The refrigeration system 16 extends forwardly of the uprights 14 at an upper portion thereof and is suspended above the display space 12 of the display case portion 10 by means (not shown) provided in the side walls 8 of the combination 3. If the combination 3 comprises more than one section, an upright 14 between each section provides support for a refrigeration system 16 provided in each section. The refrigeration system 16 includes a plenum chamber 20 in which air circulation means or fan system 22 is mounted. The system 16 also includes separate refrigeration units 24 and 27, the unit 24 including an evaporator coil 25 having an inlet side in the chamber 20 and an outlet side connected to an associated air circulation duct 26 and the refrigeration unit 27 including an evaporator coil 28 having an inlet side in the chamber 20 and an outlet side connected to an inner end of an associated air circulating duct 29. The outlet side of the duct 26 extends rearwardly of the fan system 22. A barrier plate or wall 32 lies adjacent the refrigeration unit 24 with the evaporator coil 28 of the refrigeration unit 27 displaced vertically downward therefrom to form an air duct 30 extending into the plenum chamber 20 at an inner end thereof. Outer end portions of the ducts 29 and 30 have directional louvers 33 and 34 mounted thereon at an upper edge of a front access opening 35 provided in the display case portion 10 of the combination 3. The louvers 33 and 34 are angled outwardly approximately 15° from the horizontal to thrust the refrigerated air initially outwardly to push ambient air from the refrigerated space 12.

Opposite the directional louers 33 and 34 at the lower end of the front access opening 35 to the display space 12 is provided a lower front portion **6*a* of the display case portion 10 of the combination 3 including a plenum chamber 36 having mounted therein an exhaust fan or other air ejecting device 37 mounted on a wall 38 thereof. The plenum chamber 36 has an inlet opening 39**.

The display case portion 10 of th combination 3 may also be provided with a canopy 40 secured to the front wall portion 6 overlying the display space 12 and providing illumination therefor, such as by fluorescent lights 41.

Access to the rear of the display case 10 from the walk-in cooler 9 is provided by a rear access opening (not shown) provided between adjacent uprights 14. Suitably mounted on the uprights 14 are vertically displaced shelves 43 and 44 which extend into the display space 12. Also mounted between adjacent uprights to form a barrier between the walk-in cooler space 11 and the display space 12 of the combination 3 is a curtain 46 which extends across the rear access opening to environmentally isolate the refrigerated display space 12 from the walk-in cooler space 11 of the combination 3 during normal use of the combination. The barrier or curtain 46 may be lifted or moved aside to permit access to the display case 10 from the wlak-in cooler portion 9 of the combination during times when it becomes necessary to replenish supplies of foodstuff placed on the shelves 43 and 44 of the display case. Access to the walk-in cooler portion 9 of the combination 3 is provided by a door (not shown) in the rear wet wall 7 of the combination 3. It should also be noted that roll-in carts or sections (not shown) may be used in conjunction with or in place of uprights 14 and shelves 43, 44 for displaying foodstuffs in the display case 10.

The refrigeration unit 24 operates to cool the walk-in cooler portion 9 of the case and the refrigeration unit 27 disperses refrigerated air across the front access opening 35 of the display case 10 to isolate the display case 10 environmentally from the retail market area outside the walk-in cooler display case combination 3.

OPERATION OF THE PREFERRED EMBODIMENT

Referring to the drawing described above, the structure illustrated has two separate and distinct refrigerated cooling units. The first of these refrigeration units 24 provides a means for cooling the walk-in cooler portion 9 of the combination 3. The air circulated through this unit 24 is exhausted from the cold room 9 by the fan 22 into the plenum chamber 20, maintaining the air in the chamber 20 at a pressure above that of the air in the walk-in cooler space 11 and the display space 12. The air flows from the chamber 20, through the cooling coil 25, and into the duct 26 of the refrigeration unit 24 to be pushed upwardly and rearwardly into the walk-in cooler portion 9 of the combination 3 where it is displaced downwardly due to the effects of gravity. The outer end of the duct 26 extends sufficiently rearwardly of the fan system 22 to insure that air flowing from the duct 26 will drop into the cold room by gravity and not be immediately drawn into the fan 22 for recirculation.

The second of these refrigeration units provides a means for maintaining curtains of refrigerated air across the front access opening 35 of the display case portion 10 of the combination 3. The air in the unit 27 is also exhausted from the cold room 9 by the fan 22 into the large plenum chamber 20, which maintains the air in the chamber 20 at a pressure above that of the air in the walk-in cooler space 11. The air flows from the chamber 20, into the refrigeration unit 27, where it flows through the cooling coils 28 and into the duct 29. The refrigerated air flows from the duct 29 through directional louver 33 provided at an outer end portion of the duct 29 to form an inner refrigerated air curtain 47 across the front access opening 35 of the display case portion 10. The second refrigeration unit 27 also makes provision for an air curtain 48 forward of the air curtain 47. The air curtain 48 is formed as follows. Air drawn into the plenum chamber 20 by the fan 22 from the cooler space 11 is carried along the upper duct 30 of the unit 27 to flow downwardly from the upper duct 30 through a directional louver 34 provided at the outer end portion thereof to flow across the front access opening 35 of the display case portion 10 of the combination 3. The air flowing in air curtain 48 is warmer than the air of air curtain 47 since the air of the latter curtain is re-cooled by the evaporator coil 28.

The air in curtains 47 and 48 is drawn into the plenum chamber 36 through an inlet opening 39 because the air in plenum chamber 36 is maintained below the atmospheric pressure in areas 11 and 12 by exhaust fan 37 located in the wall 38. The fan 37 thereafter ejected the air from the chamber 36 into the cold room or walk-in cooler space 11 to repeat the circulatory flow of air. The two curtains 47 and 48 thermally isolate the material on shelves 43 and 44, while permitting physical access to this material from the front of the refrigerated display case 10. The restrictions of the louvers 33, 34 and 39 are so balanced that together with the fans 22 and 37 they permit the same amount of air to enter the lower louver 39 as is exhausted from the upper louvers 33, 34 to maintain the system in balance.

The refrigeration system 16 including units 24 and 27 as well as the fan 22 associated therewith are carried between opposite side walls 8 of the combination 3 and overlie the refrigerated display space 12 of the combination 3. The supports 14 carry means thereon for supporting a barrier 46 such as a curtain or other apparatus for separating the display space 12 from the walk-in cooler space 11. The supports 14 also carry means thereon for attaching shelves 43 and 44 thereto.

It may thus be seen that the present invention provides a refrigerated case having unimpeded access at the front thereof for the display and merchandising of foodstuffs with access from the rear thereof for the replenishing of foodstuffs from the refrigerated food processing or storage area. The present invention also provides a compact system including an efficient means for circulating refrigerated air through two disparate refrigeration units for maintaining different environmental climates. The present invention also makes provision for means for supporting hardware associated with the display of refrigerated foodstuffs.

Having thus described the preferred embodiment of the present invention, it will of course be understood that various changes may be made in the form, details, arrangement and proportion of the parts without departing from the scope of the invention which consists of the matter shown and described herein and set forth in the appended claims.

We claim:

1. A refrigeration system for a combination walk-in cooler and refrigerated display case, the display case having an access opening at the front thereof for unimpeded access to the product therein, the system comprising:

first means for refrigerating the walk-in cooler, second means for refrigerating the refrigerated display case, means for establishing a plurality of air curtains extending substantially vertically across the access opening in front of the refrigerated display case serving to oppose the passage of ambient air through the access opening into the refrigerated display case, said means establishing at least an inner curtain of cooled air and an outer curtain of partially cooled air, barrier means disposed within said system for environmentally isolating the walk-in cooler portion from the display case portion of the combination, first air passage means associated with the first refrigerating means for carrying refrigerated air therefrom to the walk-in cooler portion of the combination, second air passage means associated with the second refrigerating means for carrying refrigerated air to the access opening of the display case and to said means for establishing air curtains whereby said means forms at least an inner curtain of cooled air with the refrigerated air from said second refrigerating means, and first air circulating means for supplying air to both the first and second refrigerating means for circulation therethrough and through respective first and second air passage means from the walk-in cooler and for supplying air directly to said means for establishing air curtains for forming an outer curtain of partially cooled air, second air circulating means for circulating air passing through the air curtains from said display case, through said barrier means to the walk-in cooler portion of said combination whereby the first refrigerating means cools a first portion of air from the first air circulating means to one lower temperature, the first portion of air being carried by the first passage means into the walk-in cooler portion of the combination, and the second refrigerating means cools a second portion of the air from the first air circulating means to a second lower temperature, the second portion of air being carried by the second passage means to the air curtain forming means, then utilized with a third portion of air from the first air circulating means to form air curtains across the access opening in the front of the refrigerated display case, the second and third portions of air circulated through the walk-in cooler by the second air circulating means before being returned through the first air circulating means with the first portion of air to the first and second refrigerating means for recooling first and second portions thereof.

2. A refrigeration system for a combination walk-in cooler and refrigerated display case as claimed in claim 1 wherein the system also comprises:

an upper plenum chamber capable of circulating air from the walk-in cooler to the first and second refrigeration means, a lower plenum chamber capable of circulating air from the air curtains associated with the second refrigeration means to the walk-in cooler, the upper plenum chamber maintained at a pressure greater than atmospheric pressure, and the lower plenum chamber maintained at a pressure less than atmospheric pressure, whereby air is circulated from the walk-in cooler to the upper plenum chamber, to the second refrigeration means and thereby through the air curtains to the lower plenum chamber and returned from the lower plenum chamber to the walk-in cooler.

3. A refrigeration system for a combination walk-in cooler and refrigerated display case as claimed in claim 2 wherein the first air circulating means is mounted in the upper plenum chamber at one end thereof and the first and second refrigerating means are mounted in the upper plenum chamber at an opposite end thereof.

4. A refrigeration system for a combination walk-in cooler and refrigerated display case as claimed in claim 1 wherein the first air passage means overlies the first air circulating means and extends sufficiently rearwardly thereof to permit air flowing from the first passage means into the walk-in cooler at an upper portion thereof to be dispersed therethrough by gravity.

5. A refrigeration system for a combination walk-in cooler and refrigerated display case as claimed in claim 1 wherein the first and second refrigerating means are mounted at a front upper portion of the combination to overlie the display space of the display case portion of the combination.

6. A refrigeration system for a combination walk-in cooler and refrigerated display case as claimed in claim 1 wherein support means are provided between the walk-in cooler and the refrigerated display case of the combination, the first and second means being mounted at an upper portion of the combination and overlying the support means.

7. A refrigeration system for a combination walk-in cooler and refrigerated display case as claimed in claim 6 wherein barrier means are mounted on the support means.

8. A refrigeration system for a combination walk-in cooler and refrigerated display case as claimed n claim 6 wherein the support means comprise vertically disposed columns aligned in spaced relationship along the length of the combination.

9. A refrigeration system for a combination walk-in cooler and refrigerated display case as claimed in claim 6 wherein shelving may be suitably mounted on the support means, the shelving extending outwardly into the display space of the combination for carrying foodstuffs thereon.

10. A refrigeration system for a combination walk-in cooler and refrigerated display case as claimed in claim 9 wherein the shelving is accessible through either the front or rear access opening of the display case portion of the combination.

* * * * *